US011680470B2

(12) United States Patent
El Mallawany et al.

(10) Patent No.: US 11,680,470 B2
(45) Date of Patent: Jun. 20, 2023

(54) FLOW CONTROL SYSTEM

(71) Applicant: Halliburton Energy Services, Inc., Houston, TX (US)

(72) Inventors: Ibrahim El Mallawany, Dhahran (SA); Michael Linley Fripp, Carrollton, TX (US); Stephen Michael Greci, Little Elm, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 60 days.

(21) Appl. No.: 17/346,002

(22) Filed: Jun. 11, 2021

(65) Prior Publication Data

US 2022/0397021 A1 Dec. 15, 2022

(51) Int. Cl.

| | |
|---|---|
| ***E21B 43/12*** | (2006.01) |
| ***E21B 43/38*** | (2006.01) |
| ***E21B 34/08*** | (2006.01) |

(52) U.S. Cl.

CPC ..... *E21B 43/12* (2013.01); *E21B 34/08* (2013.01); *E21B 43/38* (2013.01); *E21B 2200/02* (2020.05)

(58) Field of Classification Search

CPC ..... E21B 43/12; E21B 43/38; E21B 2200/02; E21B 34/08

See application file for complete search history.

(56) References Cited

U.S. PATENT DOCUMENTS

| | | | | |
|---|---|---|---|---|
| 9,556,706 | B1 * | 1/2017 | Zhao | E21B 43/14 |
| 2015/0308226 | A1 | 10/2015 | Killie et al. | |
| 2020/0308927 | A1 | 10/2020 | Fripp et al. | |
| 2021/0062615 | A1 | 3/2021 | Fripp et al. | |

FOREIGN PATENT DOCUMENTS

| | | | |
|---|---|---|---|
| WO | 2013106843 | A1 | 7/2013 |
| WO | 2018093516 | A1 | 5/2018 |
| WO | 2019078821 | A1 | 4/2019 |
| WO | 2019135814 | A1 | 7/2019 |
| WO | 2020040896 | A1 | 2/2020 |

OTHER PUBLICATIONS

International Search Report and Written Opinion dated Mar. 4, 2022 in International PCT Application No. PCT/US2021/039696 (11 pages).

* cited by examiner

*Primary Examiner* — D. Andrews
(74) *Attorney, Agent, or Firm* — Barnes & Thornburg LLP

(57) ABSTRACT

A flow control system selectively regulates production of a fluid from a well. The flow control system includes a plurality of flow control devices, each flow control device rotatable by a portion of the fluid and selectively directing the portion of the fluid through an outlet of the flow control device based on the density of the fluid. The system further includes a regulator valve controlled at least in part by the portion of fluid exiting the outlet of the flow control device. The regulating valve regulates production of a remaining portion of the fluid from the well.

20 Claims, 10 Drawing Sheets

FLOW CONTROL SYSTEM

BACKGROUND

In hydrocarbon production wells, it may be beneficial to regulate the flow of formation fluids from a subterranean formation into a wellbore penetrating the same. A variety of reasons or purposes may necessitate such regulation including, for example, prevention of water and/or gas coning, minimizing water and/or gas production, minimizing sand production, maximizing oil production, balancing production from various subterranean zones, equalizing pressure among various subterranean zones, and/or the like.

A number of devices are available for regulating the flow of formation fluids. Some of these devices may be non-discriminating for different types of formation fluids and may simply function as a "gatekeeper" for regulating access to the interior of a wellbore pipe, such as a well string. Such gatekeeper devices may be simple on/off valves or they may be metered to regulate fluid flow over a continuum of flow rates. Other types of devices for regulating the flow of formation fluids may achieve at least some degree of discrimination between different types of formation fluids. Such devices may include, for example, tubular flow restrictors, nozzle-type flow restrictors, autonomous inflow control devices, non-autonomous inflow control devices, ports, tortuous paths, combinations thereof, and the like.

Autonomous flow control devices may be particularly advantageous in subterranean operations, since they are able to automatically regulate fluid flow without the need for operator control due to their design. In this regard, autonomous flow control devices may be designed such that they provide a greater resistance to the flow of undesired fluids (e.g., gas and/or water) than they do desired fluids (e.g., oil, completion brine, drilling mud), particularly as the percentage of the undesired fluids increases.

DETAILED DESCRIPTION

Figure 1:
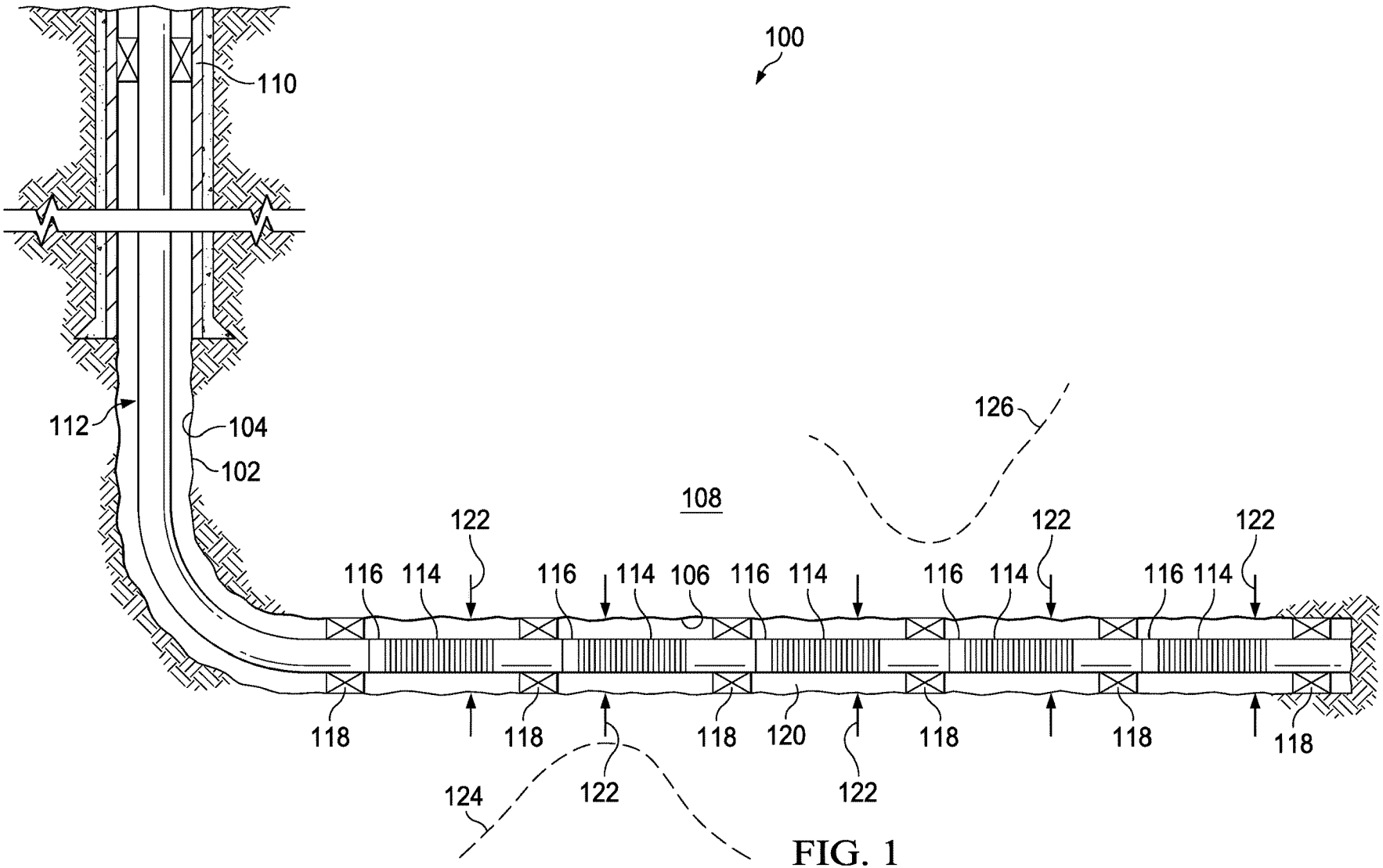
FIG. 1 illustrates a schematic view of a flow control system according to an illustrative embodiment.

In the following detailed description of several illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As used herein, the phrases "hydraulically coupled," "hydraulically connected," "in hydraulic communication," "fluidly coupled," "fluidly connected," and "in fluid communication" refer to a form of coupling, connection, or communication related to fluids, and the corresponding flows or pressures associated with these fluids. In some embodiments, a hydraulic coupling, connection, or communication between two components describes components that are associated in such a way that fluid pressure may be transmitted between or among the components. Reference to a fluid coupling, connection, or communication between two components describes components that are associated in such a way that a fluid can flow between or among the components. Hydraulically coupled, connected, or communicating components may include certain arrangements where fluid does not flow between the components, but fluid pressure may nonetheless be transmitted such as via a diaphragm or piston or other means of converting applied flow or pressure to mechanical or fluid force.

The present disclosure relates to systems and methods for regulating the production of fluid from a well. As discussed below, design features may include the addition of a suitable valve between one or more autonomous flow control devices and the production tubing string. In some examples, the valve may selectively restrict any fluid flow into a production tubing string, thereby preventing production. In other examples, the valve may selectively allow flow into the production tubing, thereby allowing production from the well. The valve, and whether it allows or prevents production of a fluid, may be hydraulically and automatically controlled by the one or more flow control devices.

FIG. 1 illustrates a well system 100 which embody principles of the present disclosure, according to one or more examples. As illustrated, well system 100 may include a wellbore 102 that comprises a generally vertical uncased section 104 that transitions into a generally horizontal section 106 that is uncased extending through a subterranean formation 108. In some examples, the vertical section 104 may extend downwardly from a portion of wellbore 102 having a string of casing 110 cemented therein. A tubular string, such as production tubing 112, may be installed in or otherwise extended into wellbore 102.

As depicted, a plurality of well screens 114, flow control systems 116, and packers 118 may be interconnected along production tubing 112, such as along portions of the production tubing 112 in horizontal section 106 of wellbore 102. Packers 118 may be configured to seal off an annulus 120 defined between production tubing 112 and the walls of wellbore 102. As a result, fluids 122 may be produced from multiple intervals of the surrounding subterranean formation 108 via isolated portions of annulus 120 between adjacent pairs of packers 118.

As illustrated, in some examples, a well screen 114 and a flow control system 116 may be interconnected in production tubing 112 and positioned between a pair of packers 118. Without limitation, well screens 114 may be swell screens, wire wrap screens, mesh screens, sintered screens, expandable screens, pre-packed screens, treating screens, or other known screen types. In operation, well screen 114 may be configured to filter fluids 122 flowing into production tubing 112 from annulus 120. Flow control system 116 may be configured to restrict or otherwise regulate the flow of fluids 122 into production tubing 112, based on certain physical characteristics of the fluids. In some embodiments, flow control system 116 may include one or more centrifugal fluid selectors, wherein a portion of the centrifugal fluid selectors may be actuated to rotate by the flow of fluids 122.

Without limitation, and as described further herein, flow control system 116 may include one or more autonomous flow control devices. The autonomous flow control device may utilize fluid dynamics and delay the flow of unwanted fluids such as water, gas and/or formation brine into the interior of production tubing 112. The autonomous flow control device may operate as a passive flow control device, not requiring operator intervention. In some embodiments, the operator may be an individual, group of individuals, or an organization. The autonomous flow control device may be any suitable shape. Without limitation, a suitable shape may include, but is not limited to, cross-sectional shapes that are circular, elliptical, triangular, rectangular, square, hexagonal, and/or combinations thereof. The autonomous flow control device may be made from any suitable material. Suitable materials may include, but are not limited to, metals, nonmetals, polymers, ceramics, and/or combinations thereof. Without limitation, the autonomous flow control device may be made from tungsten carbide and/or steel.

It will be appreciated that well system 100 is merely one example of a wide variety of well systems in which the principles of this disclosure may be utilized. Accordingly, it should be understood that the principles of this disclosure are not necessarily limited to any of the details of the depicted well system 100, or the various components thereof, depicted in the drawings or otherwise described herein. For example, it is not necessary in keeping with the principles of this disclosure for wellbore 102 to include a generally vertical section 104 or a generally horizontal section 106. Moreover, it is not necessary for fluids 122 to be only produced from subterranean formation 108 since, in other examples, fluids may be injected into subterranean formation 108, or fluids 122 may be both injected into and produced from subterranean formation 108, without departing from the scope of the disclosure.

Furthermore, it is not necessary that at least one well screen 114 and flow control system 116 be positioned between a pair of packers 118. Nor is it necessary for a single flow control system 116 to be used in conjunction with a single well screen 114. Rather, any number, arrangement and/or combination of such components may be used, without departing from the scope of the disclosure. In some applications, it is not necessary for flow control system 116 to be used with a corresponding well screen 114. For example, in injection operations, the injected fluid could be flowed through flow control system 116, without also flowing through well screen 114.

Those skilled in the art will readily recognize the advantages of being able to regulate the flow of fluids 122 into production tubing 112 from each zone of subterranean formation 108, for example, to prevent water coning 124 or gas coning 126 in subterranean formation 108. Other uses for flow regulation in a well may include, but are not limited to, balancing production from (or injection into) multiple zones, minimizing production or injection of undesired fluids, maximizing production or injection of desired fluids, etc.

Figure 4:
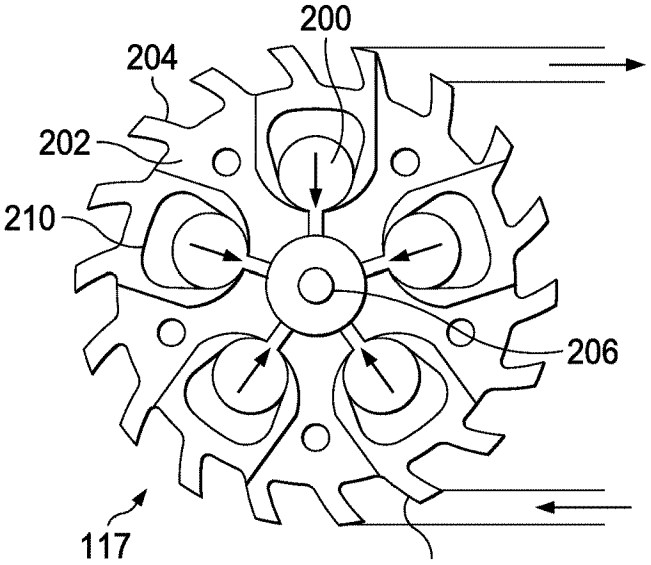
FIG. 4 illustrates a schematic view of a flow control device according to an illustrative embodiment.
Figure 5:
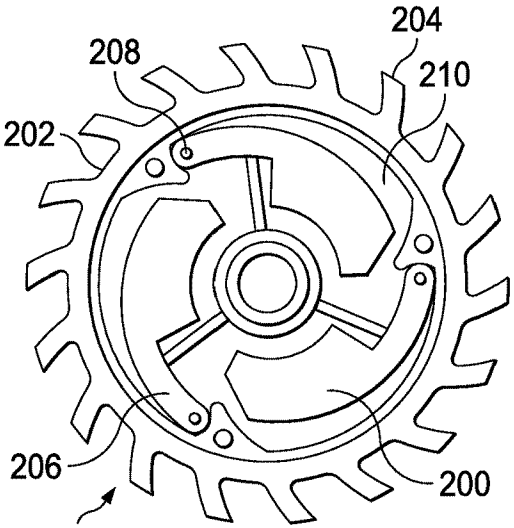
FIG. 5 illustrates a schematic view of a flow control device according to an illustrative embodiment.
Figure 2:
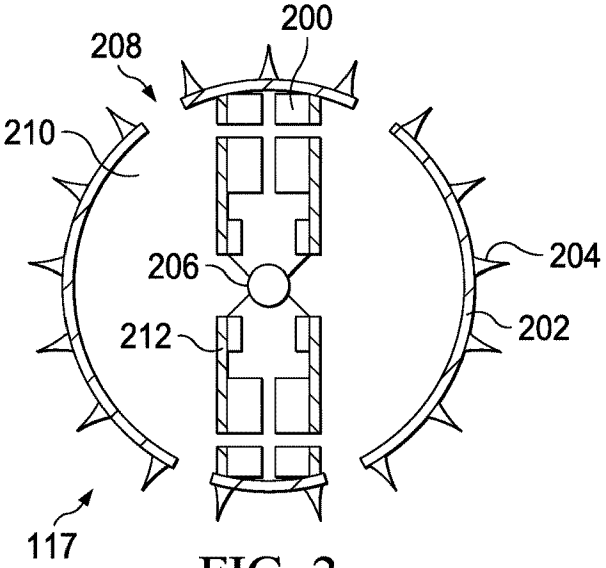
FIG. 2 illustrates a schematic view of a flow control device according to an illustrative embodiment.
Figure 3:
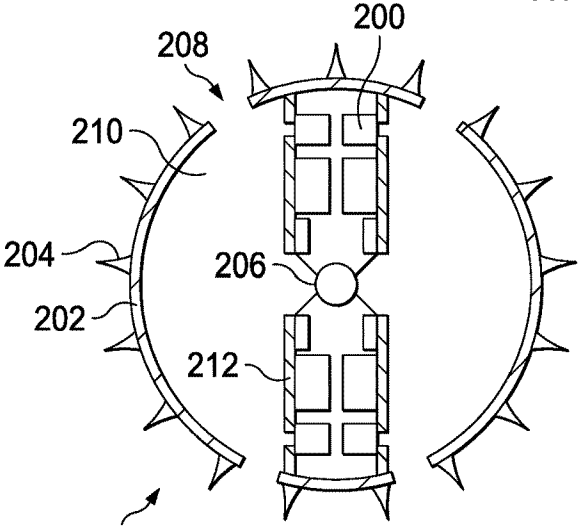
FIG. 3 illustrates a schematic view of a flow control device according to an illustrative embodiment.

FIGS. 2-7 illustrate different views of flow control devices 117 that may be incorporated into flow control system 116. FIGS. 2 and 3 depict a schematic view showing the positions of floats 200 as the flow control device 117 operates. FIGS. 4 and 5 illustrate various examples of flow control devices 117 with different arrangements for floats 200. Flow control device 117 may be designed to regulate the flow of fluids 122 (i.e., referring to FIG. 1) into production tubing 112 (i.e., referring to FIG. 1). Flow control device 117 may comprise a housing 202, protrusions 204, an outlet 206, and floats 200.

In some embodiments, housing 202 may be any suitable size, height, and/or shape. Without limitation, a suitable shape may include, but is not limited to, cross-sectional shapes that are circular, elliptical, triangular, rectangular, square, hexagonal, and/or combinations thereof. In other embodiments, housing 202 may be circular. Housing 202 may encase the internal components of flow control device 117. In examples, housing 202 may protect the internal components of flow control device 117 from an external environment. In certain examples, housing 202 may comprise protrusions 204.

Protrusions 204 may be extensions of material from housing 202, either integrally formed on the housing or instead separate components that are attached to housing 202. In examples, protrusions 204 may be any suitable size, height, and/or shape. Without limitation, a suitable shape may include, but is not limited to, cross-sectional shapes that are circular, elliptical, triangular, rectangular, square, hexagonal, and/or combinations thereof. In certain examples, protrusions 204 may visually appear and physically operate similarly to teeth on a mechanical gear. The protrusions 204 may be axially displaced from the housing 202 and may be a more similar to turbine blades such as a Kaplan turbine blades, Pelton turbine blades, Francis turbine blades, Turgo turbine blades, or crossflow turbine blades. In some embodiments, the protrusions are formed by the surface roughness of the part.

In other embodiments, protrusions 204 may be extensions of material from a ring of material that is coupled to housing 202. In these examples, the inner diameter of the ring of material may be equal to or larger than the diameter of housing 202. Depending on the inner diameter of the ring of material, there may or may not be an annulus between the ring of material and housing 202. During operations of flow control device 117, a portion of flow control device 117 may be disposed within a flow path of fluids 122 (i.e., referring to FIG. 1). In some embodiments, the flow of fluids 122 may interact with protrusions 204. As the pressure of fluids 122 increases at a contact point between fluids 122 and protrusions 204, protrusions 204 may be actuated to rotate. In certain examples, housing 202 may rotate along with protrusions 204.

In some embodiments, there may be an opening 208 between protrusions 204, or a gap or flow path near the protrusions, that allows access to an internal chamber 210 of housing 202. There may be a plurality of openings 208 that allow fluids 122 to flow from the flow path, between a set of protrusions 204, and into internal chamber 210. Internal chamber 210 may be any suitable size, height, and/or shape. Without limitation, a suitable shape may include, but is not limited to, cross-sectional shapes that are circular, elliptical, triangular, rectangular, square, hexagonal, and/or combinations thereof. Internal chamber 210 may comprise various structures and/or supports that guide the flow of fluids 122 towards outlet 206.

In some embodiments, outlet 206 may be disposed within internal chamber 210 of housing 202. Outlet 206 may be an opening that allows fluids 122 to exit flow control device 117. Outlet 206 may be coupled to a control line (discussed further below), wherein fluids 122 may flow through the control line and engage a valve (discussed further below). In some embodiments, fluids 122 that flowed through the control line may enter into the interior of production tubing 112 (i.e., referring to FIG. 1) from the valve. Alternatively, the valve may prevent the flow of fluids 122 into the interior of production tubing 112.

Flow of fluids 122 through outlet 206 may depend on the configuration of floats 200. Floats 200 may block a potential flow path of fluids 122 while in an initial position. Floats 200 may be structures designed to float when disposed in a particular fluid due to having a lower density than said fluid. The rotating motion of the housing 202 imparts a centrifugal force to the fluid and floats within the housing, which pushes the heavier (or more dense) of the fluid or floats to the outside of the housing. Floats 200 may be made from any suitable material. Suitable materials may include, but are not limited to, metals, nonmetals, polymers, glass, ceramics, and/or combinations thereof. In some embodiments, when the purpose of flow control device 117 is to distinguish between oil and water, floats 200 may be made from any material that is less dense than water and/or more dense than oil. In some embodiments the "density" of the float relative to the fluid may not be based on the density of a single material from which the float is constructed. For example, a float may be made from a combination of materials that together provide a net density (total weight of the float compared to its total volume) for the float. It would be this net density that is selected and compared to the density of the fluid. Similarly, a float may have internal voids or chambers that lower the net density of the float even though the material from which the float is made may be of a higher density. In some examples, floats 200 may be any suitable size, height, and/or shape. Without limitation, a suitable shape may include, but is not limited to, cross-sectional shapes that are circular, elliptical, triangular, rectangular, square, hexagonal, and/or combinations thereof. With reference to FIGS. 2 and 3, floats 200 may have a square cross-sectional shape. With reference to FIG. 4, floats 200 may have a circular cross-sectional shape.

In examples, as best seen on FIG. 5, floats 200 may be a customized shape and rotate about a hinge 500. As fluids 122 (i.e., referring to FIG. 1) enter flow control device 117 through openings 208, fluids 122 may push against floats 200 causing floats 200 to displace. As floats 200 displace due to a density difference, floats 200 may rotate about hinge 500. In alternate examples, floats 200 may be able to displace freely, as best seen in FIG. 4. With continued reference to either FIG. 4 or 5, as floats 200 displace due to the introduction of fluids 122, a potential flow path that leads to outlet 206 may become available to fluids 122.

In other examples, floats 200 may slide along a wall. Referring to FIGS. 2 and 3, floats 200 may be disposed between a set of walls 212 so as to constrain the path of motion of floats 200 to be one-dimensional. Floats 200 may block a potential flow path for fluids 122 to travel through in order to reach outlet 206. As flow control device 117 rotates, floats 200 may be displaced inwards (FIG. 3). This may inhibit access to the potential flow path that leads to outlet 206. As fluids 122 enter internal chamber 210 through opening 208, fluids 122 may attempt to travel through the potential flow path and out of flow control device 116 through outlet 206. If, for example, fluids 122 comprise a large concentration of water, floats 200 may remain positioned inwards towards outlet 206 and thereby block the potential flow path. If fluids 122 comprise a large concentration of oil, floats 200 may displace towards an outward position (FIG. 2), as floats 200 may be denser than oil. In other examples, flow control device 116 may be configured to restrict fluids 122 comprising a large concentration of oil and allowing fluids 122 comprising a large concentration of water to pass through outlet 206.

Figure 7:
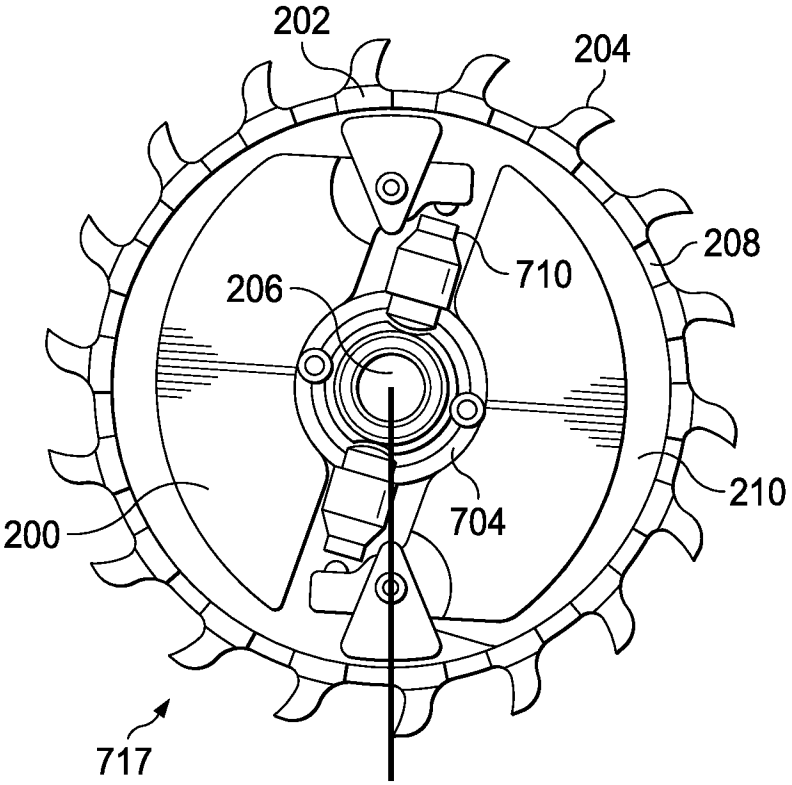
FIG. 7 illustrates a schematic view of a flow control device according to an illustrative embodiment.
Figure 6:
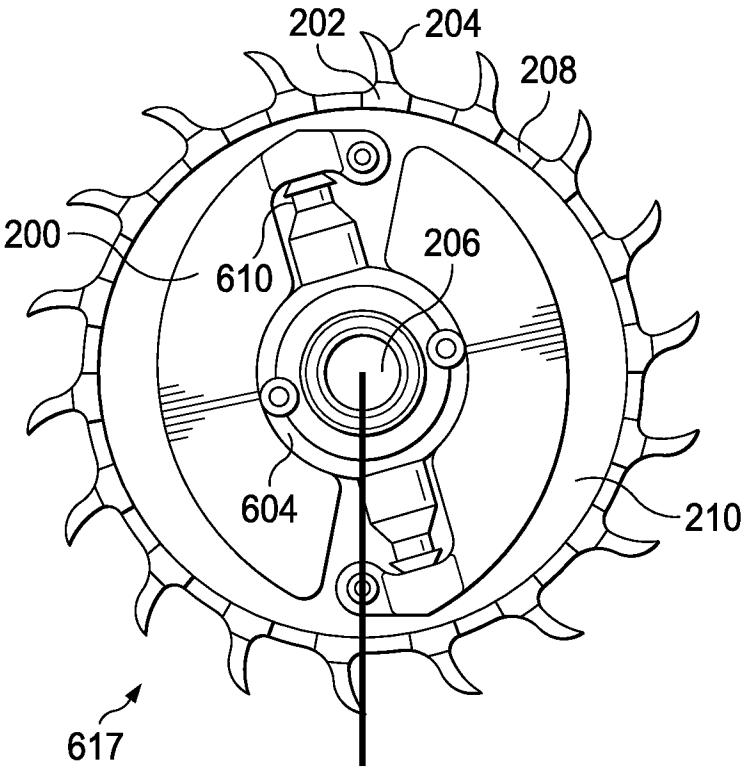
FIG. 6 illustrates a schematic view of a flow control device according to an illustrative embodiment.

FIGS. 6 and 7 illustrate alternative schematic views of flow control devices 617, 717. Similar to the hinged float described in FIG. 5, the floats 200 of FIGS. 6 and 7 are hinged and pivotally movable within the housing 202 of the flow control devices 617, 617. Each of the flow control devices 617, 617 depicted in FIGS. 6 and 7 also include protrusions 204 and outlet 206 described earlier. Each of the flow control devices 617, 617 includes a hub 604, 704 associated with and surrounding the outlet 206 and at least one port 610, 710 positioned adjacent to the hub 604, 704 that fluidly communicates with the outlet 206. The floats 200 in each of the flow control devices 617, 717 have an inner position and an outer position. In FIGS. 6 and 7, both of the flow control devices 617, 717 are depicted with the floats 200 positioned in the inner position. Referring to FIG. 6, the configuration of the float 200, including the placement of the pivotal connection, resulting in the port 610 being closed when the float 200 is positioned in the inner position. When the float 200 in this same configuration is positioned in the outer position, the port 610 is opened, thereby allowing communication of fluid through the outlet 206. Referring to FIG. 7, the configuration of the float 200, including the placement of the pivotal connection, resulting in the port 710 being open when the float 200 is positioned in the inner position. When the float 200 in this same configuration is positioned in the outer position, the port 710 is closed preventing communication of fluid through the outlet 206.

The operation of all of the flow control devices 117, 617, 717 of FIGS. 2-7 relies on the selection of floats of a particular density relative to the density of fluids to which the floats will be exposed, and also on the rotation of the flow control devices 117, 617, 717. By rotating the flow control devices, the centripetal force imparted to both the fluid within the housing 202 and the floats 200 results in the denser of the two materials (either the fluid or the floats) moving radially outward. If the density of the float is between that of oil and water, the presence of water in the housing will result in the float moving to the inner position, since the water is denser than the float and the water moves radially outward. If the fluid is oil, the float will move to the outer position since the float is denser than the oil and the float would move radially outward relative to the oil. By providing multiple configurations of the flow control devices 117, 617, 717, and by selecting the densities of the floats 200 within those flow control devices, a flow control system having multiple flow control devices can be configured to selectively control (i.e., prevent or allow) the production of multiple fluids with varying densities. The density of two or more fluids may be different even when the viscosity of the fluids is substantially the same, and the systems and methods of the present disclosure are meant to differentiate between fluid types based on the difference in the densities of each fluid type. In one example, in many Saudi Arabian formations, the oil and the water have effectively the same viscosity but significantly different density. The systems and methods described herein would differentiate between the oil and water from such a formation. For purposes of the present disclosure, two viscosities are substantially the same when the viscosities are within about 0.6 centipoise of one another.

FIGS. 8-12 depict flow control systems that selectively regulate and control production of a fluid from a well. As described in more detail below, each of the flow control systems includes a plurality of flow control devices, and each flow control device is configured to rotate when driven by a portion of the fluid from the well. The fluid is selectively directed through an outlet of each flow control device based on the density of the fluid and the density of floats in the flow control device. A regulator valve is provided and is controlled at least in part by the portion of fluid exiting the outlet of one or more flow control devices. The regulating valve, in cooperation with the flow control devices, regulates production of a remaining portion of the fluid in the well such that the fluid either is produced from the well or is prevented from being produced from the well.

Figure 8:
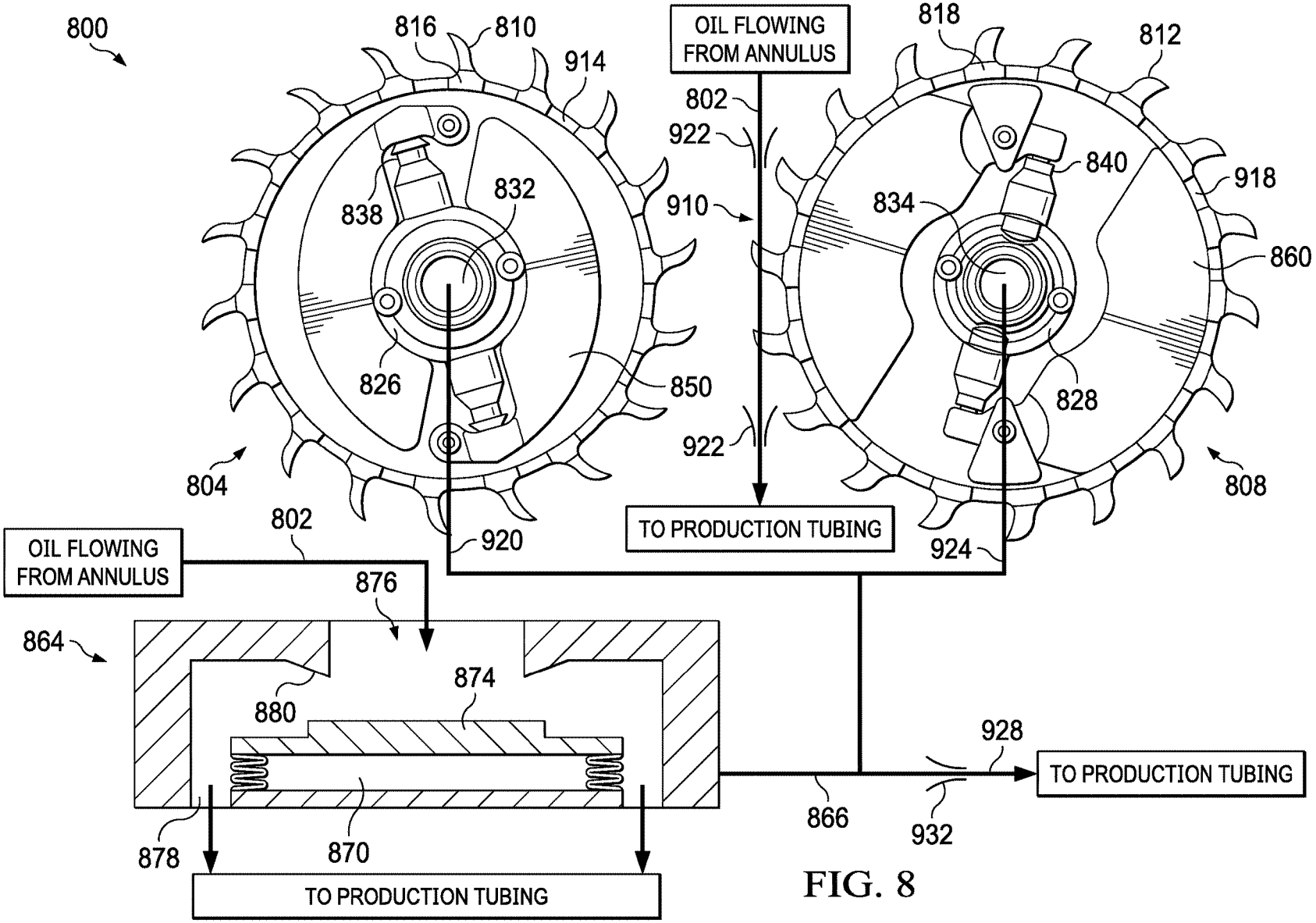
FIGS. 8-10 illustrate schematic views of a flow control system according to an illustrative embodiment.
Figure 9:
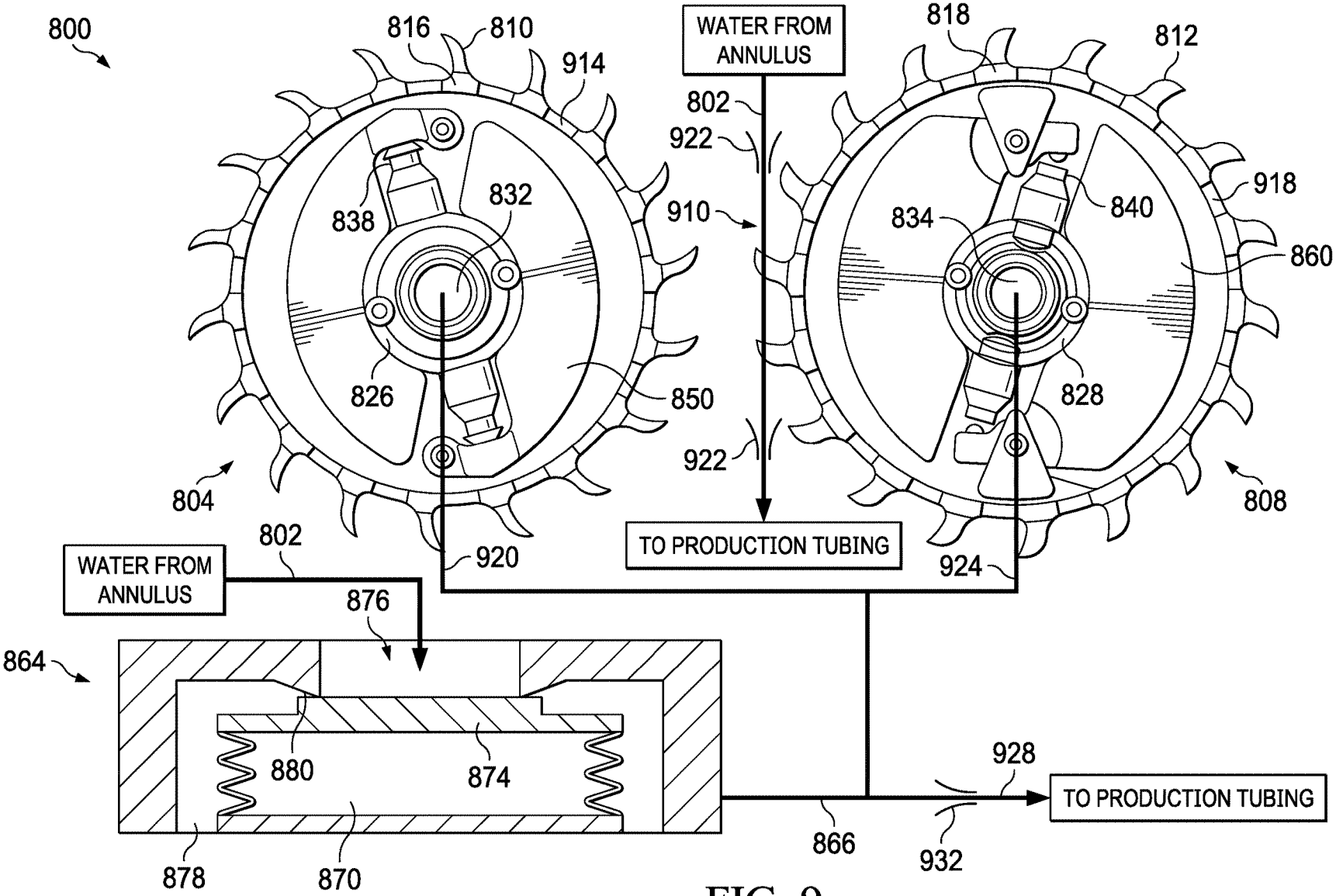
Figure 10:
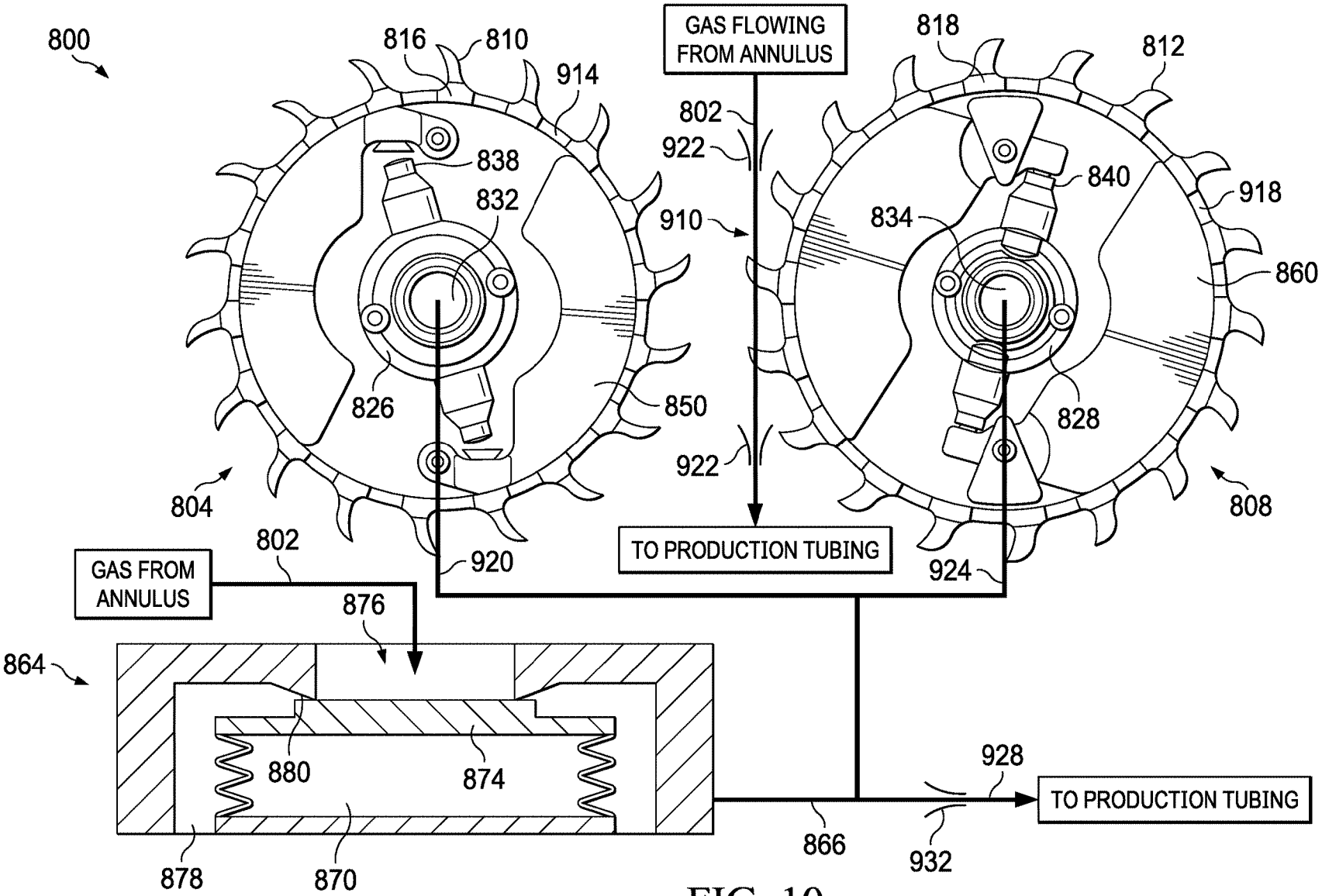

Referring now to FIGS. 8-10, a flow control system 800 is schematically illustrated according to an embodiment of the present disclosure. The flow control system 800 selectively regulates production of a fluid 802 from a well. The flow control system 800 includes a first flow control device 804 configured to rotate when exposed to flow of the fluid 802, and a second flow control device 808 configured to rotate when exposed to the fluid 802. In some embodiments, the flow control devices 804, 808 may be similar to any of the flow control devices 200, 400, 500, 600, 700 described in FIGS. 2-7. In the embodiment illustrated in FIGS. 8-10, the flow control devices 804, 808 are similar to flow control devices 617, 717, respectively. Flow control device 804 and flow control device 808 include protrusions 810, 812 positioned around housing 816, 818, respectively, to facilitate rotation of the flow control devices 804, 808 in the presence of the flowing fluid 802. Each of the flow control devices 804, 808 includes a hub 826, 828 positioned around an outlet 832, 834, respectively. In some embodiments, a port 838, 840 may be coupled to or positioned on the hub 826, 828 to provide fluid communication between an interior of the housing 816, 818 and the outlet 832, 834. While a pair of hubs is depicted in FIGS. 8-10 for each of the flow control devices, a single hub could be used, or more than two hubs may also be employed.

The first flow control device 804 may include a pair of floats 850 that are hinged and pivotally movable within the housing 816 of the flow control device 804. The floats 850 are movable between a first, or outer position (see FIG. 10), and a second, or inner position (see FIGS. 8 and 9). The configuration of the flow control device 804 and the positioning of the pivot for the floats 850 may be such that the floats 850 block fluid flow through the port 838 when the float 850 is positioned in the second position, thereby preventing fluid from within the housing 816 from flowing through the outlet 832. When the floats 850 are moved to the first position, the port 838 is opened allowing communication of fluid through the outlet 832.

The second flow control device 808 may include a pair of floats 860 that are hinged and pivotally movable within the housing 818 of the flow control device 808. The floats 860 are movable between a first, or outer position (see FIGS. 8 and 10), and a second, or inner position (see FIG. 9). The configuration of the flow control device 808 and the positioning of the pivot for the floats 860 may be such that the floats 860 block fluid flow through the port 840 when the float 860 is positioned in the first position, thereby preventing fluid from within the housing 818 from flowing through the outlet 834. When the floats 860 are moved to the second position, the port 840 is opened allowing communication of fluid through the outlet 834.

The material and density of the floats may vary depending on the particular applications of fluid control system 800 and particularly depending upon the expected conditions and fluids that will be encountered in the well. In the embodiment illustrated in FIGS. 8-10, the floats 850 of the first flow control device 804 have a density between the densities of oil and gas that may be encountered within the well, while the floats 860 of the second flow control device 808 have a density that is between the densities of oil and water. The floats 850 of the first flow control device 804 may further have a density between the densities of liquid water and gaseous water (steam). The floats 850 of the first flow control device 804 may further have a density between the densities of liquid carbon dioxide or supercritical fluid carbon dioxide and gaseous carbon dioxide.

The flow control system 800 may further include a regulator valve 864 that regulates production of fluid from the well by either allowing or preventing production of the fluid from the well. Different variations of the regulator valve are possible, but in the embodiment illustrated in FIGS. 8-10, the regulator valve includes a control line 866 fluidly coupled to a chamber 870 positioned adjacent a closure member 874 that is capable of moving between an open position (FIG. 8) and a closed position (FIGS. 9 and 10).

The regulator valve 864 is preferably disposed adjacent to or is coupled to the production string in the well, and the regulator valve 864 includes an inlet 876 that is fluidly coupled to an annulus of the well between the production string and the wellbore. The regulator valve further includes an outlet 878 that is fluidly coupled to the interior of the production string. By varying the positioning of the closure member 874 in the regulator valve, fluid in the annulus is either allowed to pass through the regulator valve 864 and into the production string, or the fluid in the annulus is prevented from passing into the production string. The regulator valve 864 may serve as the primary gateway (i.e., highest fluid flow) of the flow control system 800 when production of the fluid is allowed. The closure member 874 may be a plate, diaphragm, bellows, or other device that is capable of sealing against a seat 880 to prevent flow of fluid from the inlet 876 to the outlet 878 of the regulator valve 864.

When the pressure of fluid in the control line 866 is less than a threshold pressure, the closure member 874 remains in the open position, which allows fluid from the annulus to pass through the regulator valve 864 and into the production string. When the pressure of fluid in the control line 866 is greater than the threshold pressure, the closure member 874 moves to the closed position, which prevents fluid from the annulus from passing through the regulator valve 864, thus preventing fluid production from the well.

The routing of fluids in the flow control system 800 may be accomplished using tubing, piping, or other conduits or flow paths. In some examples, conduits may be formed within a bottom-hole assembly that houses the flow control system 800. In another example, conduits may be blocked to fluid flow but allow pressure communication, such as with a baffle or sliding piston. In FIGS. 8-10, a conduit 910 is provided to route a portion of the fluid in the annulus to the first and second flow devices 804, 808, and this portion of the fluid is used to rotate the first and second flow devices 804, 808. Further, some of the fluid from conduit 910 may be allowed to enter the housings 816, 818 through inlets 914, 918 positioned between the protrusions 810, 812. Fluid that flows through the conduit 910 past the first and second flow devices 804, 808 is allowed to enter the tubing string. Nozzles or flow restrictors 922 may be positioned at one or more locations along conduit 910 to reduce the flow through conduit 910, thereby preventing the conduit 910 from becoming a primary source of fluid production into the production string.

A first control line 920 is fluidly coupled to the outlet 832 of the first flow control device 804, and a second control line 924 is fluidly coupled to the outlet 834 of the second flow control device 808. When the outlet 832, 834 of either of the first and second flow control devices 804, 808 carries fluid from the first or second flow control device 804, 808, the respective first or second control line 920, 924 receives that fluid and is configured to carry the fluid to the control line 866 coupled to the regulator valve 864. A venting conduit 928 may be fluidly coupled to any or all of the control lines 866, 920, 924 and a nozzle or flow restrictor 932 may be provided to reduce the amount of fluid that flows into the production string through venting conduit 928.

In operation, in some embodiments, the first flow control device 804, the second flow control device 808, and the regulator valve 864 may cooperate to selectively regulate production of fluid from the well depending on what type of fluid is present in the well. Examples of possible fluids may include, in some embodiments, oil, gas, water, steam, carbon dioxide, formation brine, completion fluid, or drilling mud, or combinations of these fluids. Referring to FIG. 8, when the fluid is primarily oil, some of the oil from the annulus enters the flow control system 800, and the flow of the oil may rotate the first and second flow control devices 804, 808. A first portion of the oil enters the first flow control device 804, and since the density of the oil is greater than the density of the floats 850, the oil moves radially outward toward the housing 816, and the floats 850 move radially inward to the second position. In this second position, floats 850 close the ports 838 and block the oil from passing through the outlet 832 of the first flow control device 804. Oil therefore does not enter first control line 920. Still referring to FIG. 8, a second portion of the oil enters the second flow control device 808, and since the density of the oil is less than the density of the floats 860, the floats 860 move radially outward toward the housing 818 and into the first position, and the oil moves radially inward of the floats 860. In this first position, floats 860 close the ports 840 and block the oil from passing through the outlet 834 of the second flow control device 808. Oil therefore does not enter the second control line 924. Since oil does not flow into either first or second control lines 920, 924, fluid pressure provided to the regulator valve 864 through the control line 866 does not exceed the threshold pressure, and the closure member 874 remains in the open position. This allows the regulator valve 864 to remain open and thus allow production of the oil from the annulus to the surface through the production string.

Referring to FIG. 9, when the fluid is primarily water, some of the water from the annulus enters the flow control system 800 and the flow of the water may rotate the first and second flow control devices 804, 808. A first portion of the water enters the first flow control device 804, and since the density of the water is greater than the density of the floats 850, the water moves radially outward toward the housing 816, and the floats 850 move radially inward to the second position. In this second position, floats 850 close the ports 838 and block the water from passing through the outlet 832 of the first flow control device 804. Water therefore does not enter first control line 920. A second portion of the water enters the second flow control device 808, and since the density of the water is greater than the density of the floats 860, the water moves radially outward toward the housing 818, and the floats 860 move radially inward and into the second position of the floats 860. In this second position, floats 860 open the ports 840 and allow water within the second flow control device 808 to pass through the outlet 834 of the second flow control device 808. Water therefore passes through the outlet 834 and into the control line 924, which carries the water to the regulator valve 864 through control line 866. Fluid pressure provided to the regulator valve 864 by the water exceeds the threshold pressure, and the closure member 874 moves into the closed position. This effectively closes the regulator and prevents production of the water from the annulus to the production string.

Referring to FIG. 10, when the fluid is primarily gas, some of the gas from the annulus enters the flow control system 800 and the flow of the gas may rotate the first and second flow control devices 804, 808. A first portion of the gas enters the first flow control device 804, and since the density of the gas is less than the density of the floats 850, the floats 850 move radially outward and into the first position. The gas is displaced by the floats 850 and moves radially inward of the floats 850. In this second position, floats 850 open the ports 838 and allow gas within the second flow control device 808 to pass through the outlet 832 of the first flow control device 804. Gas therefore passes through the outlet 832 and into the control line 922, which carries the gas to the regulator valve 864 through control line 866.

Referring still to FIG. 10, a second portion of the gas enters the second flow control device 808, and since the density of the gas is less than the density of the floats 860, the floats 860 move radially outward into the first position, and the gas moves displaced and moves radially inward of the floats 860. In this first position, floats 860 close the ports 840 and prevent gas within the second flow control device 808 from passing through the outlet 834 of the second flow control device 808 into the second control line 924. Although gas is not carried through the second control line 924, the gas carried through the first control line 922 is communicated to the regulator valve 864 at a pressure that exceeds the threshold pressure. The closure member 874 therefore moves into the closed position, effectively closing the regulator and preventing production of the gas from the annulus to the production tubing.

Figure 11:
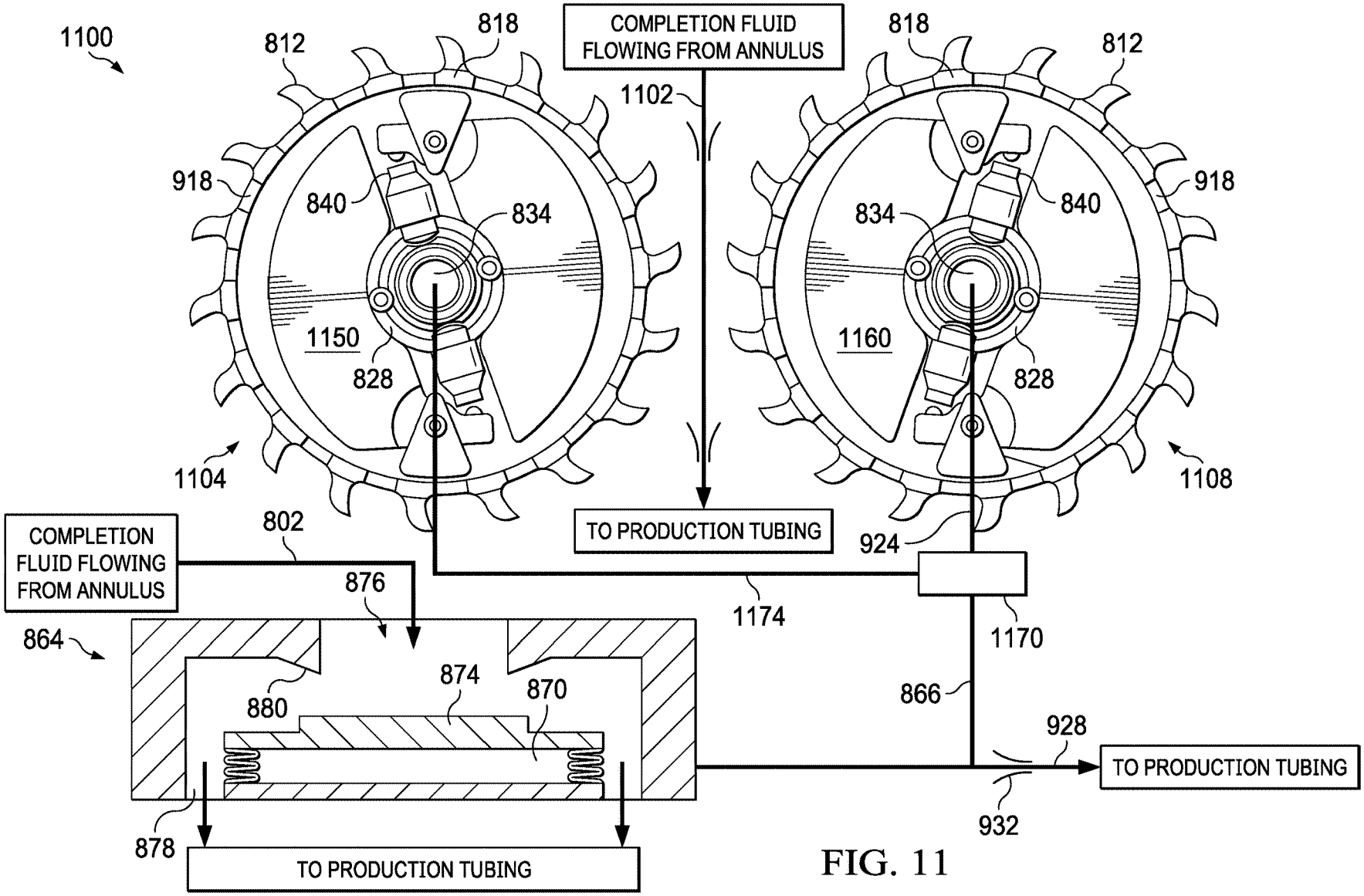
FIG. 11 illustrates a schematic view of a flow control system according to an illustrative embodiment.

FIG. 11 illustrates a schematic view of a flow control system 1100 according to an embodiment of the present disclosure. The flow control system 1100 selectively regulates production of a fluid 1102 from a well. Some components of the flow control system 1100 are similar to those examples described in flow control system 800, and the same reference numerals have been used to refer to similar parts such as the regulator valve 864.

Flow control system 1100 includes a first flow control device 1104 and a second flow control device 1108, both configured to rotate when exposed to flow of the fluid 1102. In some embodiments, the flow control devices 1104, 1108 may be similar to any of the flow control devices 200, 400, 500, 600, 700 described in FIGS. 2-7, and in some embodiments it may be desirable to substitute configurations such as those shown in FIGS. 2-7 into the flow control system 1100. In the embodiment illustrated in FIG. 11, the flow control devices 1104, 1108 are similar to flow control device 808, and include similar components such as protrusions 812, housing 818, hub 828, outlet 834, and ports 840. The structure, function and operation of these components for each of the flow control devices 1104, 1108 is similar to those described for flow control device 808.

The first flow control device 1104 may include a pair of floats 1150 that are hinged and pivotally movable within the housing 816 of the flow control device 1104. The floats 1150 are movable between a first, or outer position (not shown, but similar to that shown in FIG. 10), and a second, or inner position (FIG. 11). The configuration of the flow control device 1104 and the positioning of the pivot for the floats 1150 may be such that the floats 1150 block fluid flow through the ports 840 when the floats 1150 are positioned in the first position, thereby preventing fluid within the housing 818 from flowing through the outlet 834. When the floats 1150 are moved to the second position, the ports 840 are opened allowing communication of fluid through the outlet 834.

The second flow control device 1108 is configured with floats 1160 that are pivotally mounted the same as the floats 1150. This configuration allows the positioning of floats 1160 in the first or second position that blocks or opens the ports 840, respectively.

The material and density of the floats may vary depending on the particular applications of fluid control system 1100, and particularly depending on the expected conditions and fluids that will be encountered in the well. In the embodiment illustrated in FIG. 11, the floats 1150 of the first flow control device 1104 have a density that is between the densities of a formation brine and a completion fluid (e.g., completion brine or drilling mud) that may be encountered within the well. The floats 1160 of the second flow control device 1108 have a density between the densities of oil and water.

Flow control system 1100 allows differentiation and selective regulation of the production of additional fluids that may be encountered in the well. This represents one difference between flow control system 1100 and flow control system 800. The increased level of differentiation is due in part to the use of a pilot valve 1170 in addition to the regulator valve 864. The pilot valve 1170 is a "normally open" valve that allows or prevents fluid communication between the second control line 924 and control line 866. A pilot line 1174 is fluidly coupled between the outlet 834 of the first fluid control device 1104 and the pilot valve 1170 to control the closing of the pilot valve 1170. When the pilot line 1174 is pressurized by fluid exiting the outlet 834 of the first fluid control device 1104, the normally-open pilot valve 1170 moves to a closed position and prevents fluid communication between the second flow control device 1108 and the regulator valve 864.

The regulation of fluid production by the flow control system 1100 occurs automatically depending on the density of the fluid in the annulus that is provided to the flow control system 1100. Table 1 below provides further information regarding the operation of the flow control system 1100, including for each type of fluid presented to the flow control system 1100 ("Fluid Type"), the position of the floats 1150 ("Position 1st Floats"), the position of the floats 1160 ("Position 2nd Floats"), the presence or absence of fluid pressure in the pilot line ("Pilot Line"), the presence or absence of fluid pressure in control line 924 ("Control Line"), the status of the pilot valve ("Pilot Valve"), the status of the regulator valve ("Regulator Valve"), and the production status of the fluid ("Fluid Produced?").

TABLE 1

| Fluid Type | Position 1st Floats | Position 2nd Floats | Pilot Line | Control Line 2 | Pilot Valve | Regulator Valve | Fluid Produced? |
|---|---|---|---|---|---|---|---|
| Formation Brine | First position | Second position | No fluid pressure | Fluid pressure | Open | Closed | NO |
| Completion Fluid | Second position | Second position | Fluid pressure | Fluid pressure | Closed | Open | YES |
| Oil | First position | First position | No fluid pressure | No fluid pressure | Open | Open | YES |
| Water | First position | Second position | No fluid pressure | Fluid pressure | Open | Closed | NO |

Figure 12:
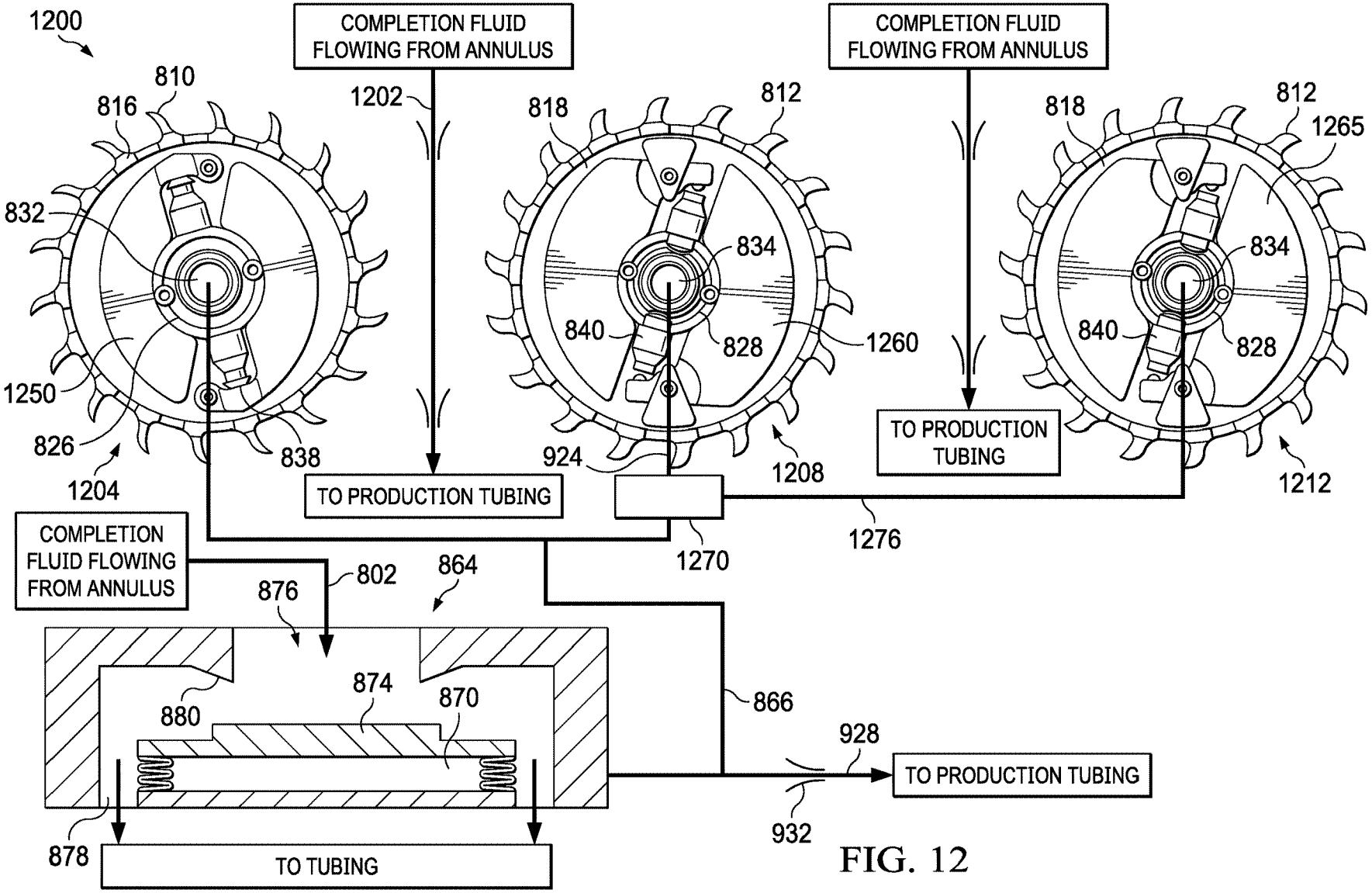
FIG. 12 illustrates a schematic view of a flow control system according to an illustrative embodiment.

FIG. 12 illustrates a schematic view of a flow control system 1200 according to an embodiment of the present disclosure. The flow control system 1200 selectively regulates production of a fluid 1202 from a well. Some components of the flow control system 1200 are similar to those examples described in flow control systems 800, 1100, and the same reference numerals have been used to refer to similar parts such as the regulator valve 864.

Flow control system 1200 includes a first flow control device 1204, a second flow control device 1208, and a third flow control device 1212, all configured to rotate when exposed to flow of the fluid 1202. In some embodiments, any of the flow control devices 200, 400, 500, 600, 700 described in FIGS. 2-7 may be substituted for the flow control devices 1204, 1208, 1212 to obtain functionality similar to that provided by flow control devices 1204, 1208, 1212. In the embodiment illustrated in FIG. 12, flow control device 1204 is similar to flow control device 804, and flow control devices 1208, 1212 are similar to flow control device 808. The flow control devices 1204, 1208, 1212 may include similar components to those described previously such as protrusions 810, 812, housings 816, 818, hubs 826, 828, outlets 832, 834, and ports 838, 840. The structure, function and operation of these components for each of the flow control devices 1204, 1208, 1210 is similar to those components in flow control devices 804, 808.

The first flow control device 1204 may include a pair of floats 1250 that are hinged and pivotally movable within the housing 814 of the flow control device 1204. The floats 1250 are movable between a first, or outer position (not shown), and a second, or inner position (FIG. 12). The configuration of the flow control device 1204 and the positioning of the pivot for the floats 1250 may be such that the floats 1250 block fluid flow through the ports 838 when the floats 1250 are positioned in the second position, thereby preventing fluid from within the housing 816 from flowing through the outlet 832. When the floats 1250 are moved to the first position, the ports 838 are opened allowing communication of fluid through the outlet 832.

The second flow control device 1208 may include a pair of floats 1260 that are hinged and pivotally movable within the housing 814 of the flow control device 1208. The floats 1260 are movable between a first, or outer position (not shown), and a second, or inner position (FIG. 12). The configuration of the flow control device 1208 and the positioning of the pivot for the floats 1260 may be such that the floats 1260 block fluid flow through the ports 838 when the floats 1260 are positioned in the first position, thereby preventing fluid from within the housing 816 from flowing through the outlet 834. When the floats 1260 are moved to the second position, the ports 840 are opened allowing communication of fluid through the outlet 834.

The third flow control device 1212 is configured with floats 1265 that are pivotally mounted the same as the floats 1260. This configuration allows the same positioning of floats 1265 in the first or second position that blocks or opens the ports 840, respectively.

The material and density of the floats may vary depending on the particular applications of fluid control system 1200, and particularly depending on the expected conditions and fluids that will be encountered in the well. In the embodiment illustrated in FIG. 12, the floats 1250 of the first flow control device 1204 have a density between the densities of oil and gas that may be encountered within the well. The floats 1260 of the second flow control device 1208 have a density between the densities of oil and water. The floats 1265 of the second flow control device 1212 have a density between the densities of a formation brine and a completion fluid that may be encountered in the well.

Flow control system 1200 allows differentiation and selective productivity of five different fluids that may be encountered in the well. This increased level of differentiation over flow control systems 800 and 1100 is due in part to the use of a pilot valve 1270 and the addition of the third flow control device 1212. The pilot valve 1270 is a "normally open" valve that allows or prevents fluid communication between the second control line 924 and control line 866. A pilot line 1276 is fluidly coupled between the outlet 834 of the third fluid control device 1212 and the pilot valve 1270 to control the closing of the pilot valve 1270. When the pilot line 1276 is pressurized by fluid exiting the outlet 834 of the third fluid control device 1212, the normally-open pilot valve 1270 moves to a closed position and prevents fluid communication between the second flow control device 1208 and the regulator valve 864.

The regulation of fluid production by the flow control system 1200 occurs automatically depending on the density of the fluid in the annulus that is provided to the flow control system 1200. Table 2 below provides further information regarding the operation of the flow control system 1200, including for each type of fluid presented to the flow control system 1200 ("Fluid Type"), the position of the floats 1250 ("Position 1st Floats"), the position of the floats 1260 ("Position 2nd Floats"), the position of the floats 1265 ("Position 3rd Floats"), the presence or absence of fluid pressure in control line 922 ("Control Line 1"), and the presence or absence of fluid pressure in control line 924 ("Control Line 2"). Table 3 provides additional information for each fluid type, including the presence or absence of fluid pressure in the pilot line 1276 ("Pilot Line"), the status of the pilot valve ("Pilot Valve"), the status of the regulator valve ("Regulator Valve"), and the status of the production of the fluid ("Fluid Produced?").

TABLE 2

| Fluid Type | Position 1st Floats | Position 2nd Floats | Position 3rd Floats | Control Line 1 | Control Line 2 |
|---|---|---|---|---|---|
| Formation Brine | Second position | Second position | First position | No fluid pressure | Fluid pressure |
| Completion Fluid | Second position | Second position | Second position | No fluid pressure | Fluid pressure |
| Oil | Second position | First position | First position | No fluid pressure | No fluid pressure |
| Water | Second position | Second position | First position | No fluid pressure | Fluid pressure |
| Gas | First position | First position | First position | Fluid pressure | No fluid pressure |

TABLE 3

| Fluid Type | Pilot Line | Pilot Valve | Regulator Valve | Fluid Produced? |
|---|---|---|---|---|
| Formation Brine | No fluid pressure | Open | Closed | NO |
| Completion Fluid | Fluid pressure | Closed | Open | YES |
| Oil | No fluid pressure | Open | Open | YES |
| Water | No fluid pressure | Open | Closed | NO |
| Gas | No fluid pressure | Open | Closed | NO |

Figure 13:
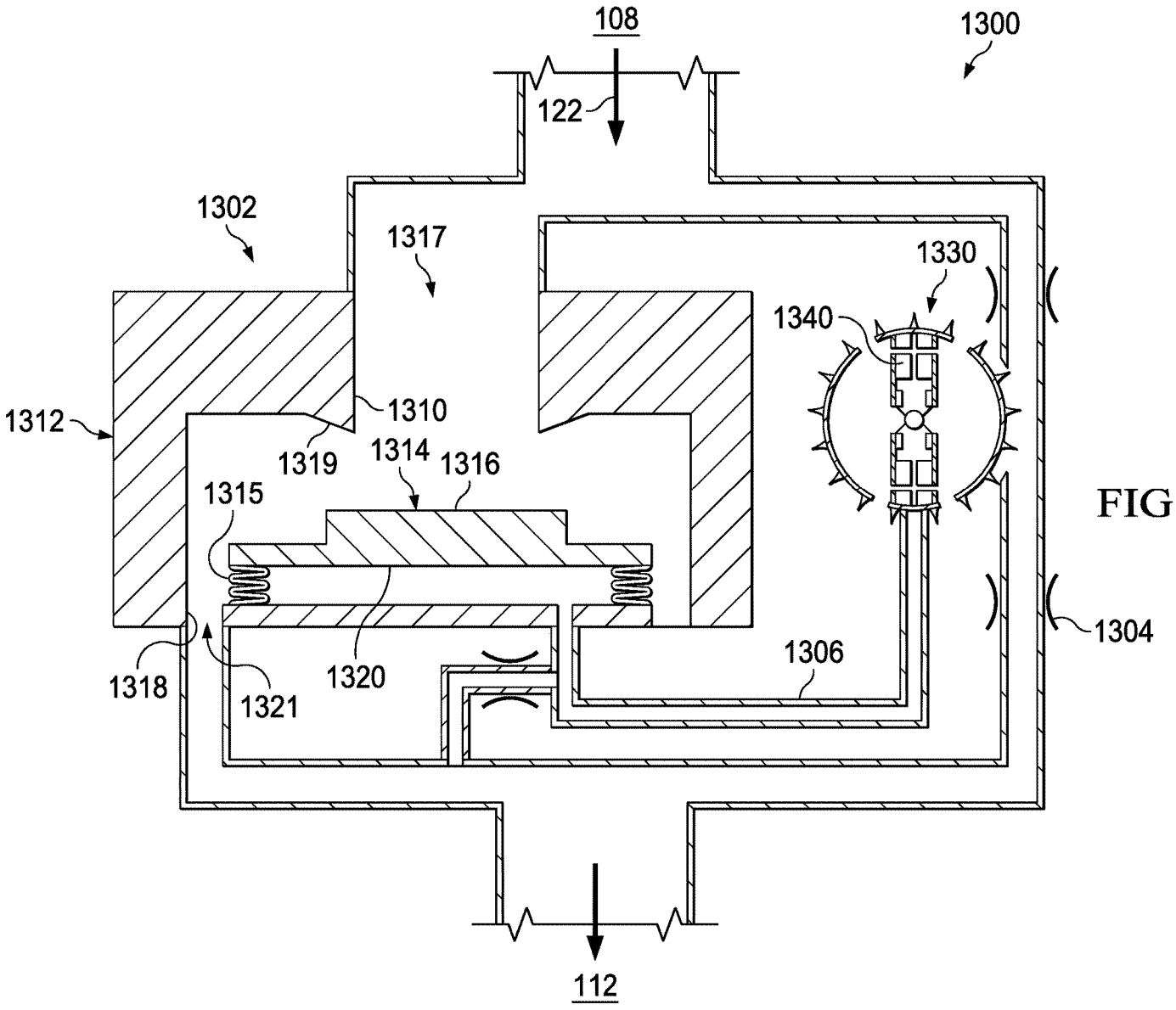
FIG. 13-14 illustrate schematic views of a flow control system according to an illustrative embodiment.
Figure 14:
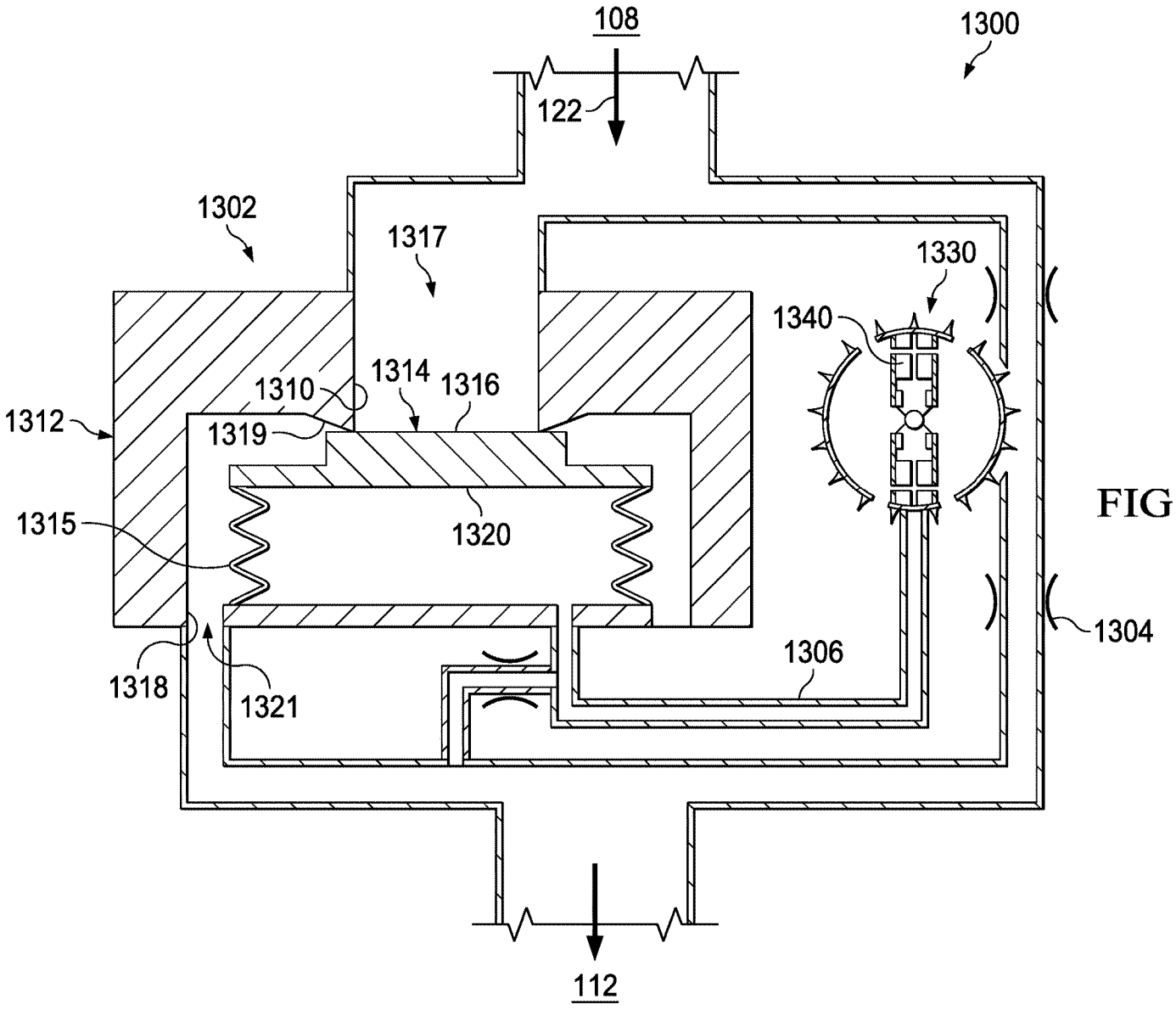

FIGS. 13 and 14 illustrate a schematic view of a flow control system 1300. FIG. 13 illustrates flow control system 1300 allowing the flow of fluids 122 (i.e., referring to FIG. 1) straight from subterranean formation 108 into production tubing 112 (i.e., referring to FIG. 1). FIG. 14 illustrates flow control system 1300 preventing the flow of fluids 122 from the subterranean formation 108 into the production tubing 112. The flow control system 1300 depicted in FIGS. 13 and 14 may operate in a similar fashion to those described in previous examples. In these particular examples, floats within one or more flow control devices may be arranged so that the flow control device may selectively allow or prevent production of fluids depending on the density of the fluids relative to the floats. In certain examples, desirable fluids that are produced include oil and completion fluid. Fluids that may be blocked and not produced include water, gas, and formation brine.

Flow control system 1300 may include a regulatory valve 1302 having a piston 1314 coupled to valve housing 1312 by bellows 1315. In alternate examples, a diaphragm (not illustrated) may be used in place of bellows 1315. Bellows 1315 may be any suitable size, height, and/or shape and may comprise walls that expand and/or compress when acted upon. Bellows 1315 may couple piston 1314 onto an internal wall of valve housing 1312 through the use of any suitable mechanisms, including, but not limited to, the use of suitable fasteners, threading, adhesives, welding, and/or combinations thereof. Without limitation, suitable fasteners may include nuts and bolts, washers, screws, pins, sockets, rods and studs, hinges and/or any combination thereof.

Regulatory valve 1302 may further comprise an inlet restriction 1317, a piston seat 1319, and an outlet restriction

1321. Without limitations, inlet restriction 1317 may be any of a nozzle, a vortex, a change in tubing and/or pipe diameter, fluid diode, and/or other centrifugal fluid selector disposed near valve inlet 1310. Piston seat 1319 may serve to receive piston 1314 as piston 1314 is actuated to displace linearly. Piston seat 1319 may have any suitable size, height, and/or shape compatible to receive piston 1314. In examples, there may be a pressure drop as the flow of fluids 122 passes piston seat 1319. As the flow of fluids 122 travels through regulatory valve 1302, fluids may encounter outlet restriction 1321. Without limitations, outlet restriction 1321 may be any of a nozzle, a vortex, a change in tubing and/or pipe diameter, fluid diode, and/or other centrifugal fluid selector disposed near valve outlet 1318.

The flow control system 1300 may further include one or more flow control devices 1330 that may have one or more floats 1340. While illustrated in FIGS. 13 and 14 as a single flow control device, any configuration of multiple flow control devices described herein may be sued in the flow control system 1300.

If fluids 122 are mostly comprised of oil, then there may be little flow of fluids 122 through flow control device 1330 and subsequently through control line 1306 (as best shown in FIG. 13). In this example, fluids 122 may flow past flow control device 1330 and encounter a pressure reduction from fluid restrictor 1304. As the pressure within this flow path of fluids 122 has been greatly reduced, fluids 122 may alternatively flow through regulatory valve 1302. As these fluids 122 comprise pressure from subterranean formation 108 and there is little to no pressure being applied to piston 1314 from control line 1306, piston 1314 may be actuated to displace so as to allow fluids 122 to flow out of valve outlet 1318 and into an interior of production tubing 112. Displacing piston 1314 to create a greater flow path for fluids 122 may comprise of compressing bellows 1315.

If fluids 122 are mostly comprised of water, then fluids 122 may enter and exit flow control device 1130 and flow through control line 1306, wherein control line 1306 may be coupled to regulatory valve 1302. As illustrated, control line 1306 may exit into an interior of bellows 1315. As control line 1306 provides fluids 122 in an interior of bellows 1315, the pressure within may build and be applied to second end 1320 of piston 1314. In some embodiments, the pressure applied to second end 1320 may be greater than the pressure supplied by subterranean formation 108. The pressure supplied by subterranean formation 108 may encounter inlet restriction 1317 and piston seat 1319 prior to being applied to first end 1316 of piston 1314. As such, piston 1314 may be actuated to displace so that first end 1316 inhibits the flow of fluids 122 from entering into valve inlet by abutting against piston seat 1319.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure.

Clause 1, a flow control system to selectively regulate production of a fluid from a well comprises a plurality of flow control devices, each flow control device rotatable by a portion of the fluid and selectively directing the portion of the fluid through an outlet of the flow control device based on the density of the fluid; and a regulator valve controlled at least in part by the portion of fluid exiting the outlet of the flow control device, the regulating valve regulating production of a remaining portion of the fluid from the well.

Clause 2, the system of clause 1, wherein the flow control device includes a float configured to move into a first position or a second position based on the density of the fluid, the positioning of the float determining whether the portion of the fluid is directed to the outlet of the flow control device.

Clause 3, a flow control system to selectively regulate production of a fluid from a well comprises a first flow control device configured to rotate when exposed to the fluid, the first flow control device having a first float of a first density, the first float positioned to allow or prevent flow of a first portion of the fluid through an outlet of the first flow control device depending on whether the fluid has a density less or greater than the first density; a second flow control device configured to rotate when exposed to the fluid, the second flow control device having a second float of a second density, the second float positioned to allow or prevent flow of a second portion of the fluid through an outlet of the second flow control device depending on whether the fluid has a density less or greater than the second density; and a regulator valve regulating production of a third portion of the fluid from the well based on the positioning of at least one of the first float and the second float.

Clause 4, the system of clause 3, wherein the regulator valve regulates production by allowing or preventing production of the third portion of the fluid from the well.

Clause 5, the system of clauses 3 or 4, further comprising a first control line fluidly coupled to the outlet of the first flow control device; and a second control line fluidly coupled to the outlet of the second flow control device.

Clause 6, the system of any of clauses 3-5, wherein the first density of the first float is between the density of oil and the density of gas, the first float positionable in a first position and a second position, the first float in the first position allowing flow of the first portion of the fluid through the outlet of the first flow control device, the first float in the second position preventing flow of the first portion of the fluid through the outlet of the first flow control device; and the second density of the second float is between the density of oil and the density of water, the second float positionable in a first position and a second position, the second float in the first position preventing flow of the second portion of the fluid through the outlet of the second flow control device, the second float in the second position allowing flow of the second portion of the fluid through the outlet of the second flow control device.

Clause 7, the system of clause 6, wherein flow of the first portion of the fluid from the outlet of the first flow control device or flow of the second portion of the fluid from the outlet of the first flow control device closes the regulator valve to prevent production of the third portion of the fluid from the well.

Clause 8, the system of clause 7, wherein when the fluid is oil, the first float is in the second position, the second float is in the first position, and the regulator valve is open to allow production of the oil; when the fluid is water, the first float is in the second position, the second float is in the second position, and the regulator valve is closed to prevent production of the water; and when the fluid is gas, the first float is in the first position, the second float is in the first position, and the regulator valve is closed to prevent production of the gas.

Clause 9, the system of clause 3, wherein the first density of the first float is between the density of a formation brine and the density of a completion fluid, the first float positionable in a first position and a second position, the first float in the first position preventing flow of the first portion of the fluid through the outlet of the first flow control device, the first float in the second position allowing flow of the first portion of the fluid through the outlet of the first flow control device; and the second density of the second float is between the density of oil and the density of water, the second float positionable in a first position and a second position, the second float in the first position preventing flow of the second portion of the fluid through the outlet of the second flow control device, the second float in the second position allowing flow of the second portion of the fluid through the outlet of the second flow control device.

Clause 10, the system of clause 9 further comprising a pilot valve and a pilot line fluidly coupled between the pilot valve and the outlet of the first flow control device; the pilot valve being normally positioned in an open position, the pilot valve closing to a closed position when the pilot line is pressurized by the first portion of the fluid flowing from the outlet of the first flow control device; wherein the outlet of the second flow control device is fluidly coupled to the pilot valve; wherein the regulator valve is fluidly coupled to the pilot valve; wherein the pilot valve in the open position allows fluid communication between the outlet of the second flow control device and the regulator valve; wherein the pilot valve in the closed position prevents fluid communication between the outlet of the second flow control device and the regulator valve.

Clause 11, the system of clause 10, wherein when the fluid is oil, the first float is in the first position, the second float is in the first position, and the regulator valve allows production of the oil; when the fluid is completion fluid, the first float is in the second position, the second float is in the second position, the pilot valve is in the closed position, and the regulator valve allows production of the completion fluid; when the fluid is formation brine, the first float is in the first position, the second float is in the second position, the pilot valve is in the open position, and the regulator valve prevents production of the formation brine; and when the fluid is water, the first float is in the first position, the second float is in the second position, the pilot valve is in the open position, and the regulator valve prevents production of the water.

Clause 12, the system of clause 3 further comprising a third flow control device configured to rotate when exposed to the fluid, the third flow control device having a third float of a third density, the third float positioned to allow or prevent flow of a fourth portion of the fluid through an outlet of the third flow control device depending on whether the fluid has a density less or greater than the third density.

Clause 13, the system of clause 12, wherein the first density of the first float is between the density of oil and the density of gas, the first float positionable in a first position and a second position, the first float in the first position allowing flow of the first portion of the fluid through the outlet of the first flow control device, the first float in the second position preventing flow of the first portion of the fluid through the outlet of the first flow control device; the second density of the second float is between the density of oil and the density of water, the second float positionable in a first position and a second position, the second float in the first position preventing flow of the second portion of the fluid through the outlet of the second flow control device, the second float in the second position allowing flow of the second portion of the fluid through the outlet of the second flow control device; and the third density of the third float is between the density of a formation brine and the density of a completion fluid, the third float positionable in a first position and a second position, the third float in the first position preventing flow of the fourth portion of the fluid through the outlet of the third flow control device, the third float in the second position allowing flow of the fourth portion of the fluid through the outlet of the third flow control device.

Clause 14, the system of clause 13 further comprising a pilot valve and a pilot line fluidly coupled between the pilot valve and the outlet of the third flow control device; the pilot valve being normally positioned in an open position, the pilot valve closing to a closed position when the pilot line is pressurized by the fourth portion of the fluid flowing from the outlet of the third flow control device; wherein the outlet of the second flow control device is fluidly coupled to the pilot valve; wherein the pilot valve is fluidly coupled to the regulator valve; wherein the outlet of the first flow control device is fluidly coupled to the regulator valve; wherein the pilot valve in the open position allows fluid communication between the outlet of the second flow control device and the regulator valve; wherein the pilot valve in the closed position prevents fluid communication between the outlet of the second flow control device and the regulator valve.

Clause 15, the system of clause 14, wherein when the fluid is oil, the first float is in the second position, the second float is in the first position, the third float is in the first position, and the regulator valve allows production of the oil; when the fluid is completion fluid, the first float is in the second position, the second float is in the second position, the third float is in the second position, the pilot valve is in the closed position, and the regulator valve allows production of the completion fluid; when the fluid is gas, the first float is in the first position, the second float is in the first position, the third float is in the first position, the pilot valve is in the open position, and the regulator valve prevents production of the gas; when the fluid is formation brine, the first float is in the second position, the second float is in the second position, the third float is in the first position, the pilot valve is in the open position, and the regulator valve prevents production of the formation brine; and when the fluid is water, the first float is in the second position, the second float is in the second position, the third float is in the first position, the pilot valve is in the open position, and the regulator valve prevents production of the water.

Clause 16, a method of regulating production of a fluid from a well, the method comprising directing a first portion of the fluid to a first flow control device, and based on the density of the fluid, preventing or allowing the first portion of the fluid to enter a first conduit; directing a second portion of the fluid to a second flow control device, and based on the density of the fluid, preventing or allowing the second portion of the fluid to enter a second conduit; and allowing or preventing production of a remaining portion of the fluid based on the presence or absence of the first portion of fluid in the first control line and the second portion of fluid in the second control line.

Clause 17, the method of clause 16, further comprising rotating the first flow control device; and rotating the second flow control device.

Clause 18, the method of clauses 16 or 17, wherein allowing or preventing production of a remaining portion of the fluid further comprises controlling operation of a regulating valve with at least one of the first portion of the fluid in the first conduit and the second portion of the fluid in the second conduit.

Clause 19, the method of any of clauses 16-18, wherein directing a first portion of the fluid to a first flow control device and directing a second portion of the fluid to a second flow control device further comprises moving a first float in the first flow control device into a first position or a second position depending on the density of the fluid relative to the density of the first float, the positioning of the first float determining whether the first portion of the fluid is allowed to enter the first conduit; moving a second float in the second flow control device into a first position or a second position depending on the density of the fluid relative to the density of the second float, the positioning of the second float determining whether the second portion of the fluid is allowed to enter the second conduit.

Clause 20, the method of any of clauses 16-19, wherein the determination of whether the first portion of the fluid enters the first conduit and the second portion of the fluid enters the second conduit depends on the positioning of a float in each of the first and second flow control devices, the float positioned based on the density of the fluid relative to the density of the float.

Clause 21, the system or method of any of the preceding clauses, wherein the system or method is operable to detect the difference between at least two fluids, and whether each of the fluids should be produced from the well, based on the density of the fluids.

Clause 22, the system or method of clause 22, wherein the at least two fluids may have substantially the same viscosity even though the density of the at least two fluids is different.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

We claim:

1. A flow control system to selectively regulate production of a fluid from a well, the system comprising:

a first flow control device configured to rotate when exposed to the fluid, the first flow control device having a first float of a first density, the first float positioned to allow or prevent flow of a first portion of the fluid through an outlet of the first flow control device depending on whether the fluid has a density less or greater than the first density;

a second flow control device configured to rotate when exposed to the fluid, the second flow control device having a second float of a second density, the second float positioned to allow or prevent flow of a second portion of the fluid through an outlet of the second flow control device depending on whether the fluid has a density less or greater than the second density;

the first density of the first float is between the density of oil and the density of gas, the first float positionable in a first position and a second position, the first float in the first position allowing flow of the first portion of the fluid through the outlet of the first flow control device, the first float in the second position preventing flow of the first portion of the fluid through the outlet of the first flow control device; and the second density of the second float is between the density of oil and the density of water, the second float positionable in a first position and a second position, the second float in the first position preventing flow of the second portion of the fluid through the outlet of the second flow control device, the second float in the second position allowing flow of the second portion of the fluid through the outlet of the second flow control device; and a regulator valve regulating production of a third portion of the fluid from the well based on the positioning of at least one of the first float and the second float.

2. The system of claim 1, wherein the regulator valve regulates production by allowing or preventing production of the third portion of the fluid from the well.

3. The system of claim 1, further comprising:

a first control line fluidly coupled to the outlet of the first flow control device; and a second control line fluidly coupled to the outlet of the second flow control device.

4. The system of claim 1, wherein:

flow of the first portion of the fluid from the outlet of the first flow control device or flow of the second portion of the fluid from the outlet of the first flow control device closes the regulator valve to prevent production of the third portion of the fluid from the well.

5. The system of claim 4, wherein:

when the fluid is oil, the first float is in the second position, the second float is in the first position, and the regulator valve is open to allow production of the oil;

when the fluid is water, the first float is in the second position, the second float is in the second position, and the regulator valve is closed to prevent production of the water; and when the fluid is gas, the first float is in the first position, the second float is in the first position, and the regulator valve is closed to prevent production of the gas.

6. The system of claim 1 further comprising:

a third flow control device configured to rotate when exposed to the fluid, the third flow control device having a third float of a third density, the third float positioned to allow or prevent flow of a fourth portion of the fluid through an outlet of the third flow control device depending on whether the fluid has a density less or greater than the third density.

7. The system of claim 6, wherein:

the third density of the third float is between the density of a formation brine and the density of a completion fluid, the third float positionable in a first position and a second position, the third float in the first position preventing flow of the fourth portion of the fluid through the outlet of the third flow control device, the third float in the second position allowing flow of the fourth portion of the fluid through the outlet of the third flow control device.

8. The system of claim 7 further comprising:

a pilot valve and a pilot line fluidly coupled between the pilot valve and the outlet of the third flow control device; the pilot valve being normally positioned in an open position, the pilot valve closing to a closed position when the pilot line is pressurized by the fourth portion of the fluid flowing from the outlet of the third flow control device;

wherein the outlet of the second flow control device is fluidly coupled to the pilot valve;

wherein the pilot valve is fluidly coupled to the regulator valve;

wherein the outlet of the first flow control device is fluidly coupled to the regulator valve;

wherein the pilot valve in the open position allows fluid communication between the outlet of the second flow control device and the regulator valve; and wherein the pilot valve in the closed position prevents fluid communication between the outlet of the second flow control device and the regulator valve.

9. The system of claim 8, wherein:

when the fluid is oil, the first float is in the second position, the second float is in the first position, the third float is in the first position, and the regulator valve allows production of the oil;

when the fluid is completion fluid, the first float is in the second position, the second float is in the second position, the third float is in the second position, the pilot valve is in the closed position, and the regulator valve allows production of the completion fluid;

when the fluid is gas, the first float is in the first position, the second float is in the first position, the third float is in the first position, the pilot valve is in the open position, and the regulator valve prevents production of the gas;

when the fluid is formation brine, the first float is in the second position, the second float is in the second position, the third float is in the first position, the pilot valve is in the open position, and the regulator valve prevents production of the formation brine; and when the fluid is water, the first float is in the second position, the second float is in the second position, the third float is in the first position, the pilot valve is in the open position, and the regulator valve prevents production of the water.

10. A method of regulating production of a fluid from a well, the method comprising:

directing a first portion of the fluid to a first flow control device, and based on the density of the fluid, preventing or allowing the first portion of the fluid to enter a first conduit;

moving a first float in the first flow control device into a first position or a second position depending on the density of the fluid relative to the density of the first float, the positioning of the first float determining whether the first portion of the fluid is allowed to enter the first conduit; wherein the first density of the first float is between the density of oil and the density of gas, between the density of oil and the density of water, or between the density of a formation brine and the density of a completion fluid;

directing a second portion of the fluid to a second flow control device, and based on the density of the fluid, preventing or allowing the second portion of the fluid to enter a second conduit;

moving a second float in the second flow control device into a first position or a second position depending on the density of the fluid relative to the density of the second float, the positioning of the second float determining whether the second portion of the fluid is allowed to enter the second conduit; wherein the second density of the second float is a selection of one of: between the density of oil and the density of gas, between the density of oil and the density of water, or between the density of a formation brine and the density of a completion fluid; but wherein the second density is not the same selection as the first density; and allowing or preventing production of a remaining portion of the fluid based on the presence or absence of the first portion of fluid in a first control line and a second portion of fluid in the second control line.

11. The method of claim 10, further comprising:

rotating the first flow control device; and rotating the second flow control device.

12. The method of claim 10, wherein allowing or preventing production of a remaining portion of the fluid further comprises:

controlling operation of a regulating valve with at least one of the first portion of the fluid in the first conduit and the second portion of the fluid in the second conduit.

13. The method of claim 10, wherein the determination of whether the first portion of the fluid enters the first conduit and the second portion of the fluid enters the second conduit depends on the positioning of a float in each of the first and second flow control devices, the float positioned based on the density of the fluid relative to the density of the float.

14. A flow control system to selectively regulate production of a fluid from a well, the system comprising:

a first flow control device configured to rotate when exposed to the fluid, the first flow control device having a first float of a first density, the first float positioned to allow or prevent flow of a first portion of the fluid through an outlet of the first flow control device depending on whether the fluid has a density less or greater than the first density;

a second flow control device configured to rotate when exposed to the fluid, the second flow control device having a second float of a second density, the second float positioned to allow or prevent flow of a second portion of the fluid through an outlet of the second flow control device depending on whether the fluid has a density less or greater than the second density;

the first density of the first float is between the density of a formation brine and the density of a completion fluid, the first float positionable in a first position and a second position, the first float in the first position preventing flow of the first portion of the fluid through the outlet of the first flow control device, the first float in the second position allowing flow of the first portion of the fluid through the outlet of the first flow control device; and the second density of the second float is between the density of oil and the density of water, the second float positionable in a first position and a second position, the second float in the first position preventing flow of the second portion of the fluid through the outlet of the second flow control device, the second float in the second position allowing flow of the second portion of the fluid through the outlet of the second flow control device; and a regulator valve regulating production of a third portion of the fluid from the well based on the positioning of at least one of the first float and the second float.

15. The system of claim 14 further comprising:

a pilot valve and a pilot line fluidly coupled between the pilot valve and the outlet of the first flow control device; the pilot valve being normally positioned in an open position, the pilot valve closing to a closed position when the pilot line is pressurized by the first portion of the fluid flowing from the outlet of the first flow control device;

wherein the outlet of the second flow control device is fluidly coupled to the pilot valve;

wherein the regulator valve is fluidly coupled to the pilot valve;

wherein the pilot valve in the open position allows fluid communication between the outlet of the second flow control device and the regulator valve; and wherein the pilot valve in the closed position prevents fluid communication between the outlet of the second flow control device and the regulator valve.

16. The system of claim 15, wherein:

when the fluid is oil, the first float is in the first position, the second float is in the first position, and the regulator valve allows production of the oil;

when the fluid is completion fluid, the first float is in the second position, the second float is in the second position, the pilot valve is in the closed position, and the regulator valve allows production of the completion fluid;

when the fluid is formation brine, the first float is in the first position, the second float is in the second position, the pilot valve is in the open position, and the regulator valve prevents production of the formation brine; and when the fluid is water, the first float is in the first position, the second float is in the second position, the pilot valve is in the open position, and the regulator valve prevents production of the water.

17. The system of claim 14 further comprising:

a third flow control device configured to rotate when exposed to the fluid, the third flow control device having a third float of a third density, the third float positioned to allow or prevent flow of a fourth portion of the fluid through an outlet of the third flow control device depending on whether the fluid has a density less or greater than the third density.

18. The system of claim 17, wherein:

the third density of the third float is between the density of oil and the density of gas, the third float positionable in a first position and a second position, the third float in the first position preventing flow of the fourth portion of the fluid through the outlet of the third flow control device, the third float in the second position allowing flow of the fourth portion of the fluid through the outlet of the third flow control device.

19. The system of claim 18 further comprising:

a pilot valve and a pilot line fluidly coupled between the pilot valve and the outlet of the third flow control device; the pilot valve being normally positioned in an open position, the pilot valve closing to a closed position when the pilot line is pressurized by the fourth portion of the fluid flowing from the outlet of the third flow control device;

wherein the outlet of the second flow control device is fluidly coupled to the pilot valve;

wherein the pilot valve is fluidly coupled to the regulator valve;

wherein the outlet of the first flow control device is fluidly coupled to the regulator valve;

wherein the pilot valve in the open position allows fluid communication between the outlet of the second flow control device and the regulator valve; and wherein the pilot valve in the closed position prevents fluid communication between the outlet of the second flow control device and the regulator valve.

20. The system of claim 19, wherein:

when the fluid is oil, the first float is in the second position, the second float is in the first position, the third float is in the first position, and the regulator valve allows production of the oil;

when the fluid is completion fluid, the first float is in the second position, the second float is in the second position, the third float is in the second position, the pilot valve is in the closed position, and the regulator valve allows production of the completion fluid;

when the fluid is gas, the first float is in the first position, the second float is in the first position, the third float is in the first position, the pilot valve is in the open position, and the regulator valve prevents production of the gas;

when the fluid is formation brine, the first float is in the second position, the second float is in the second position, the third float is in the first position, the pilot valve is in the open position, and the regulator valve prevents production of the formation brine; and when the fluid is water, the first float is in the second position, the second float is in the second position, the third float is in the first position, the pilot valve is in the open position, and the regulator valve prevents production of the water.

* * * * *